US006264065B1

(12) United States Patent
Jouillat

(10) Patent No.: US 6,264,065 B1
(45) Date of Patent: Jul. 24, 2001

(54) DEVICE FOR BIPHASIC DISPENSING OF A SINGLE DOSE

(75) Inventor: Claude Jouillat, Montigny-sur-Avre (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/214,137

(22) PCT Filed: Jun. 26, 1997

(86) PCT No.: PCT/FR97/01150

§ 371 Date: Oct. 4, 1999

§ 102(e) Date: Oct. 4, 1999

(87) PCT Pub. No.: WO98/01360

PCT Pub. Date: Jan. 15, 1998

(30) Foreign Application Priority Data

Jul. 5, 1996 (FR) ..... 96 08380

(51) Int. Cl.[7] ..... B65D 35/22

(52) U.S. Cl. ..... 222/94; 222/103; 222/632; 239/307; 239/327

(58) Field of Search ..... 222/93, 94, 95, 222/103, 106, 107, 132, 135, 136, 145.1, 145.5, 145.6, 214, 630, 631, 632; 239/303, 304, 307, 310, 311, 327, 328

(56) References Cited

U.S. PATENT DOCUMENTS

| | | | | |
|---|---|---|---|---|
| 1,661,564 | * | 3/1928 | Ebbesen | 222/107 |
| 3,224,640 | * | 12/1965 | Schneider et al. | 222/107 |
| 3,897,005 | * | 7/1975 | Reiner | 239/327 |
| 4,072,249 | * | 2/1978 | Ekenstam et al. | 222/95 |
| 4,275,840 | | 6/1981 | Staar . | |
| 4,331,264 | * | 5/1982 | Staar | 222/94 |
| 4,534,509 | * | 8/1985 | Holzner | 239/34 |
| 4,657,134 | * | 4/1987 | Woodworth et al. | 222/206 |
| 4,858,831 | * | 8/1989 | Spector | 239/326 |
| 4,872,556 | * | 10/1989 | Farmer | 222/94 X |
| 4,890,744 | * | 1/1990 | Lane, Jr. et al. | 222/107 X |
| 5,215,221 | * | 6/1993 | Dirksing | 222/94 |
| 5,373,966 | * | 12/1994 | O'Reilly et al. | 222/94 |
| 5,950,871 | * | 9/1999 | De Pous et al. | 222/88 |

FOREIGN PATENT DOCUMENTS

| | | |
|---|---|---|
| 0421710A | 4/1991 | (EP) . |
| 2369 181 | 5/1978 | (FR) . |
| 2443 980 | 7/1980 | (FR) . |
| 0572 663 | 10/1945 | (GB) . |

* cited by examiner

*Primary Examiner*—Kevin Shaver
*Assistant Examiner*—David Deal
(74) *Attorney, Agent, or Firm*—Rockey, Milnamow & Katz, Ltd.

(57) ABSTRACT

The invention includes a device for dispensing in atomized powder form a single dose of a fluid product. A fluid product container contains a single dose and is connected to an atomizing orifice. At least one gas container is connected to the orifice. A means is provided for simultaneously emptying the fluid product container and the gas container so as to cause a biphasic atomization of the fluid product with the gas at the atomizing orifice.

21 Claims, 1 Drawing Sheet

DEVICE FOR BIPHASIC DISPENSING OF A SINGLE DOSE

FIELD OF THE INVENTION

The present invention relates to a device for the biphasic dispensing, in spray form, of a single dose of fluid product. More particularly, the invention relates to a miniature spray device, preferably disposable, which is particularly suitable for samples in the field of pharmacy or perfumery.

BACKGROUND OF THE INVENTION AND TECHNICAL PROBLEMS POSED BY THE PRIOR ART

The problems that arise for such a product dispenser involve, in particular, the need for inexpensive manufacturing processes. In effect, since samples are not generally intended for sale, the manufacturing cost must be as low as possible. It is therefore important to have devices whose parts are easy to produce in large series and the mounting of which can be done simply. Furthermore, since the samples are used mainly for advertising purposes, it is desirable to be able to visibly affix the brand, the logo, or any other distinctive sign corresponding to the product contained in the dispenser. Likewise, it is desirable to provide a device in a form that is original and practical for use. For example, in the case of samples to be included in magazines or journals, it is necessary for the dispenser to have a greatly reduced thickness.

The dispensing device according to the invention can also be applied in the pharmaceutical field. In this particular field, it is important for the dose of product contained in the dispenser to be completely expelled. Furthermore, it is also important for the spray to be of good quality.

For example, known through French Patent No. A-2,443,980 is a disposable sprayer produced by the fusion of a sheet of plastic material, placing between it a container as well as two channels of vortex connected to a spray opening. By pressure on the container whose walls are produced by sheets of plastic, product is discharged into the vortex channels, then through the spray opening, creating a stream of sprayed product. This disposable sprayer does not, however, make it possible to expel a defined dose of product. Moreover, the production of vortex channels by the fusion of two sheets of plastic is rather imprecise and random. According to a version of this sprayer, the container is divided into two chambers by a partition that is broken under the action of the pressure. One chamber is filled with a fluid while the other contains the product and air. Furthermore, the container is separated from the spray opening by a point of rupture. In a first step, when one presses on the container, the partition breaks, and the two fluids are to varying degrees mixed together with air. In any case, the mixture thus obtained cannot be homogeneous. By increasing the pressure, the point of rupture breaks and the nonhomogeneous mixture is discharged towards the spray opening. The stream leaving the opening is sometimes composed of the first fluid, sometimes of the second fluid, and sometimes of air, but is never composed of a homogeneous mixture of the three. It results that the stream is sometimes purely aqueous and sometimes biphasic. Its quality is therefore not constant.

The problem that the present invention proposes to solve is the production of an inexpensive dispensing device that provides a good quality of spray of a single dose of product in a constant and precise volume. In certain applications, particularly advertising applications, the dispensing device must meet certain dimensional requirements; in particular, it must have a reduced thickness.

BRIEF SUMMARY OF THE INVENTION

These problems are solved, according to the present invention, by a device for dispensing, in spray form, of a single dose of fluid product, characterized by the fact that it includes:

a container of fluid product containing the single dose and connected to a spray opening, at least one container of gas connected to the spray opening, and some means of simultaneously emptying the containers of fluid product and of gas, in such a way as to create a biphasic spray of fluid product and gas at the site of the spray opening.

The use of a spray gas mixed with the product at the site of the spray opening guarantees a good quality of spray of the single dose of product that is expelled. The use of a spray gas makes it possible to avoid the need of the force of pressure that has to be applied in the case of a simple pump equipped with a nozzle with a vortex chamber. Less pressure is sufficient to provide a sprayed stream of good quality.

Advantageously, the containers have deformable flexible wall elements that make it possible to empty the containers by pressing on said wall elements. Just as in the aforementioned Belgian document, the pressure that makes the spraying possible is directly exerted on the container. One can thus work without a connected component such as a piston. However, the means of emptying include a component for pressing on the deformable flexible wall elements of the containers. The pressing component in effect makes it possible to completely empty the container of product, which ensures a precise quantity of expelled product.

According to an advantageous characteristic, the containers are arranged in such a way that the emptying of said container of gas, of which there is at least one, begins before the emptying of said container of fluid product. In a corresponding manner, the containers are arranged in such a way that the emptying of said gas container, of which there is at least one, is completed after the emptying of said fluid product container.

According to a practical embodiment, the pressing component presses on the flexible wall elements of said gas container, of which there is at least one, before pressing on the flexible wall element of said fluid product container. It is thus guaranteed that the entire volume of the dose is emitted with an optimal spray quality, that is to say with the simultaneous emission of gas under pressure.

According to another practical embodiment, the containers have outlet channels connecting them to the spray opening, with the pressing component being formed by an essentially rigid rounded tab articulated with respect to the containers in such a way as to progressively press on the wall elements of the containers, beginning with their ends farthest from the outlet channels. Progressive and simultaneous emptying of the containers of fluid and of gas is thus produced.

In order to guarantee a minimal thickness, that is to say less than 5 mm, preferably less than 3 mm, the containers are formed between an essentially rigid support and a flexible barrier film forming the deformable flexible wall elements. The support can be produced from polypropylene, polyethylene, or a mixture of these; the barrier film can be produced by a superposition of layers of polyester, aluminum, polyamide, and polyethylene.

Furthermore, the tab is formed by an operating part of the support, which is shaped in a rounded manner and connected by a hinge to another main part of the support bearing the containers. Moreover, the outlet channels and the spray opening are formed between the support and the barrier film. Advantageously, the barrier film is fused to or glued on the support.

According to another characteristic, a retention and dispersion fiber is placed before the spray opening. The fiber is placed both between the outlet channels and the spray opening and between the support and the barrier film.

According to another practical characteristic, the spray opening is closed by a cap component, which can be removed. By producing or incorporating all of the components of the dispensing device between a support and a barrier film glued or fused together, it is possible to produce the device at a very low cost. The fiber placed just before the spray opening makes possible a good dispersion of the droplets of product soaked in the fiber and passed through by the flow of pressurized air coming from the gas containers.

Other characteristics and particularities of the invention will emerge from the following detailed description giving an embodiment of the present invention as a nonlimiting example in reference to the accompanying drawings.

DETAILED DESCRIPTION OF THE INVENTION

Figure 2:
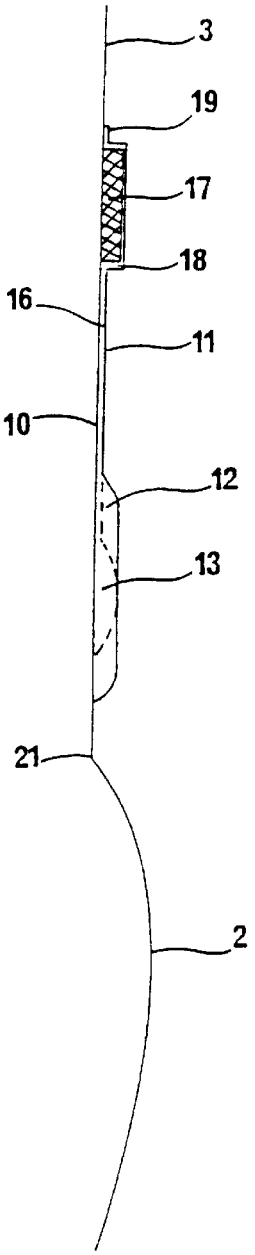
FIG. 2 is a view in cross section through the dispensing device of FIG. 1.
Figure 1:
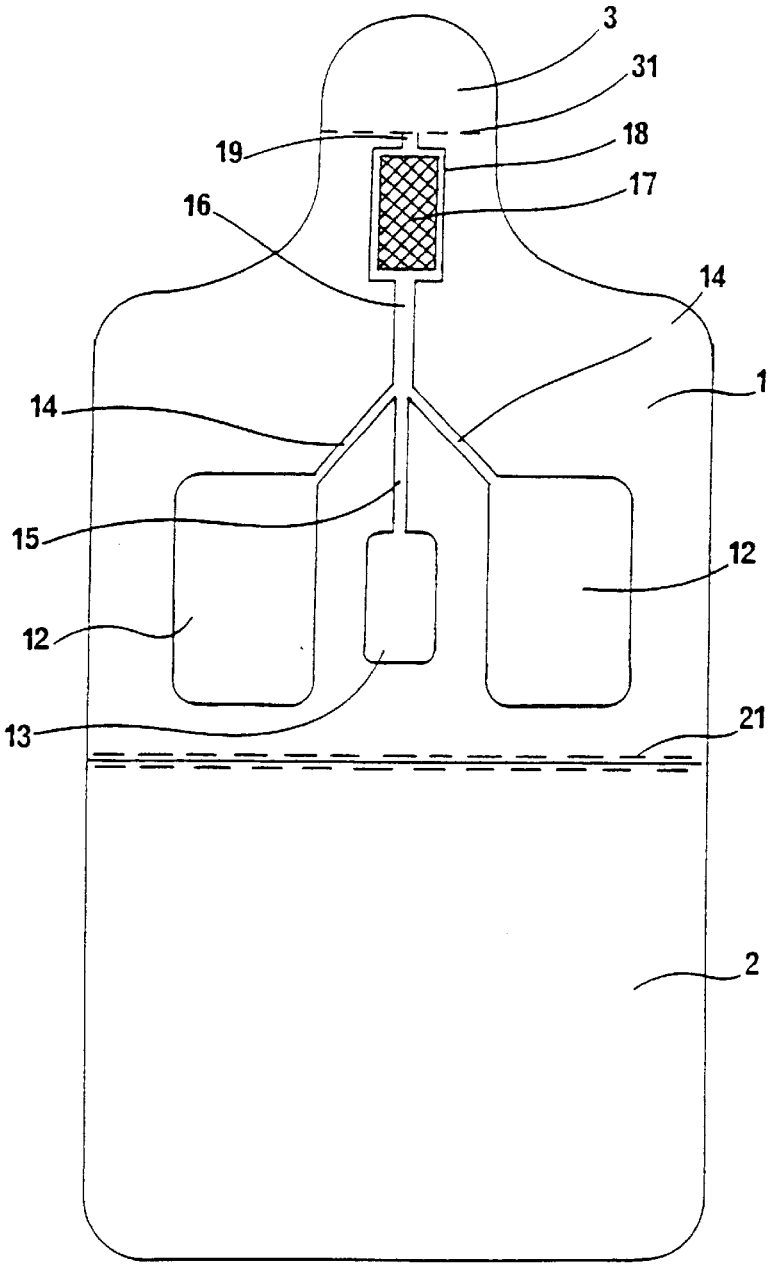
FIG. 1 is a plane view of a single-dose biphasic dispensing device according to the present invention.

The single-dose biphasic dispensing device of FIGS. 1 and 2 is represented on an enlarged scale: in reality, the dispensing device is inscribed in a rectangle of approximately 6 cm by 3 cm. As for its thickness, it does not exceed 5 mm and will preferably be less than 3 mm when the device is intended to be included in a magazine as an advertising sample.

In reference now more particularly to the figures, one sees that the dispensing device according to this preferred embodiment of the invention essentially has three constitutive elements, namely essentially rigid support 10, flexible barrier film 11, and plug of fiber 17 whose function will be explained hereafter.

Essentially rigid support 10 can be made of any material in sheet form providing a certain rigidity. Preferably, support 10 is made from polyethylene, polypropylene, or a mixture of these.

As for flexible barrier film 11, it can be produced from any material in flexible sheet form, which can be deformed by simple pressure, for example, by means of a finger. Preferably, film 11 is produced by a superposition of layers of polyester, aluminum, polyamide, and polyethylene in order to thus form a barrier complex.

According to the invention, barrier film 11 is fused or heat-glued on essentially rigid support 10 over a major part of the surface of the support. In certain determined spots, barrier film 11 is not fused on support 10, and a certain volume is then formed between the film and the support. These non-heat-glued zones are formed on main part 1 of support 10, which includes three parts in all, namely the above-mentioned main part 1, operating part 2 connected to main part 1 by hinge 21, and head part 3 connected to main part 1 by tear line 31. Film 11 can be heat-glued on the three parts 1, 2, and 3 of support 10, but at the least film 11 extends over main part 1 and head part 3 of support 10. Operating part 2 then only consists of support 10. Hinge 21, which connects operating part 2 to main part 1 of support 10, can be produced in the form of a line or several lines of lesser thickness, which promotes the folding of part 2 with respect to part 1. As can be seen in FIG. 2, operating part 2 has a rounded profile in cross section, whose convexity is oriented on the same side as film 11 for reasons to be given later.

The determined zones of main part 1 of support 10 on which barrier film 11 is not heat-glued define several containers 12, 13, 12, several channels 14, 15, 16, housing 18 intended to receive plug of fiber 17, and spray opening 19. Before use, that is to say in its storage and transport state, spray opening 19 is closed by head part 3 that functions as a cap component that can be removed. Spray opening 19 is in reality closed by the fact that barrier film 11 is heat-fused on support 10 in head part 3. Just upstream from spray opening 19 is the housing for receiving plug of fiber 17. The two lateral containers 12 are connected by respective outlet channels 14 to shared channel 16, which opens into housing 18 for receiving plug of fiber 17. Central container 13 is itself also connected by outlet channel 15 to shared channel 16 connected to receiving housing 18. Thus, the three containers are connected to the spray opening via a channel network 14, 15, 16 and receiving housing 18 that receives plug of fiber 17. In the case in which the device is a sample of perfume, for example, fiber 17 must be as flat as possible. On the other hand, when the device is a nasal sprayer, for example, in the field of pharmacy, fiber 17 and its housing 18 can also have a cylindrical cross section in order to form a nasal end piece. According to the invention, the two lateral containers 12, 12 are gas containers, preferably filled with air. As for central container 13, it is filled with fluid product corresponding to the single dose that is to be dispensed. Simultaneous pressure on the three containers 12, 13, 12 has the effect of expelling the respective fluid (fluid product, gas) through the respective ducts 14, 15, 14, then through shared channel 16 into receiving housing 18 for receiving plug of fiber 17. The mixture of fluid product and gas that has already formed in shared channel 16 is completely dispersed and divided through plug of fiber 17. The stream of fluid product coming out of the spray opening thus has a very good spray quality, on the one hand because of the mixture of the fluid product with a gas resulting in a biphasic mixture, and on the other hand because of the presence of plug of fiber 17 acting as a disperser in order to divide the fluid product into very fine droplets that are propelled by the gas.

The pressure exerted on containers 12, 13, 12 can be brought about by means of one or more fingers, but preferably, as represented in FIGS. 1 and 2, the dispensing device is provided with a pressing component or tab in the form of operating part 2. Due to this pressing component 2, simultaneous pressure on the containers as well as complete emptying are ensured. This pressure and emptying result can be obtained due to the rounded shape of pressing component 2, as defined in the preceding. Because of this rounded shape, pressing component 2, once folded over main part 1, begins to press on the deformable flexible walls produced by flexible barrier film 11 starting from their end farthest from outlet channels 14, 15, 14. The rounded shape of pressing component 2 ensures progressive flattening of the containers so that it is not possible for fluid to remain in the containers. Simultaneous progressive emptying of the entire contents of the containers is thus ensured.

According to an additional advantageous characteristic, gas containers 12, 12 extend further towards hinge 21 than fluid product container 13, so that pressing component 2, once folded, begins first to press on gas containers 12 before pressing on fluid product container 13. The emptying of gas containers 12, 12 thus begins before the emptying of fluid product container 13. In this way, it is ensured that gas is expelled through channels 14 and channel 16, then through plug of fiber 17 before fluid product is expelled. A perfect biphasic spray quality of fluid product is thus guaranteed by preventing fluid product from being expelled in a manner other than in the form of a mixture with the gas.

Symmetrically, gas containers 12 extend further away from hinge 21 than fluid product container 13. This means that gas will continue to be expelled after fluid product container 13 is empty. Due to this characteristic, a perfect biphasic spray quality is ensured again by preventing fluid product from being expelled without mixing beforehand with gas. In other words, the biphasic spraying of the fluid product is preceded and followed by the expulsion of pressurized gas.

Because of the small number of constitutive elements of the dispensing device according to the invention, it can be produced at low cost with relatively simple manufacturing techniques. Moreover, because of its small thickness, preferably less than 3 mm, it can be easily packaged and stacked with no risk. It should be understood that the number of gas and fluid product containers of the execution example that has just been described is completely arbitrary and can vary without consequently leaving the scope of the invention.

I claim:

1. A device for dispensing, in spray form, a single dose of fluid product, wherein the device includes:

a container of fluid product containing the single dose and connected to a spray opening, at least one container of gas connected to said spray opening, and means for simultaneously emptying said containers of fluid product and of gas, in such a way as to create a biphasic spray of fluid product and gas at the site of the spray opening, said fluid product container and said at least one gas container having deformable flexible wall elements that make it possible to empty the containers by pressing on said wall elements to reduce the volume of said containers.

2. A dispensing device according to claim 1, in which means of emptying (11, 2) include a pressing component (2) for a pressing on the deformable flexible wall elements (11) of said fluid product container and said at least one gas container.

3. A dispensing device according to claim 1 or 2, in which said fluid product container and said at least one gas container are arranged in such a way that the emptying of said at least one container of gas (12), begins before the emptying of said container of fluid product (13).

4. A dispensing device according to claim 1 or 2, in which said fluid product container and said at least one gas container are arranged in such a way that the emptying of said at least one gas container (12) is completed after the emptying of said fluid product container (13).

5. A dispensing device according to claim 2, in which said pressing component (2) presses on said flexible wall elements (11) of said at least one gas container (12) before pressing on said flexible wall element (11) of said fluid product container (13).

6. A dispensing device according to claim 2, in which said fluid product container and said at least one gas container have outlet channels (14, 15, 16) connecting them to the spray opening, with the pressing component being formed by essentially rigid rounded tab (2) articulated with respect to said fluid product container and said at least one gas container in such a way as to press progressively on said wall elements (11) of the said fluid product container and said at least one gas container beginning with their ends farthest from the outlet channels.

7. A dispensing device according to claim 6, in which said tab (2) is formed by an operating part of a support (10), which is shaped in a rounded manner and is connected by a hinge (21) to a main part (1) of the support (10) which bears containers said fluid product container and said at least one gas container.

8. A dispensing device according to claim 6, in which a fiber (17) is placed both between the outlet channels and the spray opening and between a support (10) and a barrier film (11).

9. A dispensing device according to claim 1 or 2, in which said fluid product container and said at least one gas container are formed between an essentially rigid support (10) and a flexible barrier film (11) forming the deformable flexible wall elements.

10. A dispensing device according to claim 9, in which the outlet channels (14, 15, 16) and the spray opening are formed between the support (10) and the barrier film (11).

11. A dispensing device according to claim 9, in which the barrier film (11) is fused to or glued on the support (10).

12. A dispensing device according to claim 9, in which the support (10) is produced from polypropylene, polyethylene, or a mixture thereof.

13. A dispensing device according to claim 9, in which the barrier film (11) is produced by a superposition of layers of polyester, aluminum, polyamide, and polyethylene.

14. A dispensing device according to claim 1 or 2, in which a retention and dispersion fiber (17) is placed before said spray opening (19).

15. A dispensing device according to claim 1 or 2, in which said spray opening (19) is closed by cap component (3), which can be removed.

16. A dispensing device according to claim 15, in which the cap component, which can be removed, is formed by a head part (3) of a support (10), which is covered with a barrier film (11) and connected to main part (1) by a tear line (31).

17. A dispensing device according to claim 1 or 2, in which the thickness of said dispensing device is less than 3 mm to 5 mm.

18. A device for dispensing, in spray form, of a single dose of fluid product, wherein the device includes:

a container of fluid product containing the single dose and connected to a spray opening, and at least one container of gas connected to said spray opening, each said container having a deformable flexible wall element that makes it possible to empty the containers by pressing on said wall element; and a pressing component for pressing on each said container deformable flexible wall element for simultaneously emptying said containers of fluid product and of gas at the site of the spray opening and wherein said pressing component begins to press on said gas container flexible wall element prior to pressing on said fluid product container flexible wall element.

19. A device for dispensing, in spray form, of a single dose of fluid product, wherein the device includes:

a container of fluid product containing the single dose and connected to a spray opening, and at least one container of gas connected to said spray opening, each said container having a deformable flexible wall element that makes it possible to empty the containers by pressing on said wall element, each said container having outlet channels connecting them to the spray opening; and a pressing component for pressing on each said container deformable flexible wall element for simultaneously emptying said containers of fluid product and of gas in such a way as to create a biphasic spray of fluid product and gas at the site of the spray opening, said pressing component being formed by an essentially rigid rounded tab articulated with respect to said containers in such a way as to press progressively on said deformable, flexible, wall elements of the containers, beginning with their ends farthest from the outlet channels.

20. A device for dispensing, in spray form, a single does of fluid product, wherein the device includes:

a container of fluid product containing the single dose and connected to a spray opening, and at least one container of gas connected to said spray opening, said containers being formed between an essentially rigid support and a flexible barrier film forming deformable, flexible, wall elements; and a tab formed by an operating part of said rigid support and shaped in a rounded manner, said tab being connected by a hinge to another, main part of said rigid support for pressing against said containers for simultaneously emptying said containers of fluid product and of gas in such a way as to create a biphasic spray of fluid product and gas at the site of the spray opening.

21. A device for dispensing, in spray form, of a single does of fluid product, wherein the device includes:

a container of fluid product containing the single dose and connected to a spray opening;

at least one container of gas connected to said spray opening;

means for simultaneously emptying said containers of fluid product and of gas in such a way as to create a biphasic spray of fluid product and gas at the site of the spray opening; and a retention and dispersion fiber located upstream of said spray opening.

* * * * *